US009512855B2

(12) United States Patent
Lin

(10) Patent No.: US 9,512,855 B2
(45) Date of Patent: Dec. 6, 2016

(54) CEILING FAN

(71) Applicant: Hsun-Yu Lin, Taichung (TW)

(72) Inventor: Hsun-Yu Lin, Taichung (TW)

( * ) Notice: Subject to any disclaimer, the term of this patent is extended or adjusted under 35 U.S.C. 154(b) by 471 days.

(21) Appl. No.: 14/265,421

(22) Filed: Apr. 30, 2014

(65) Prior Publication Data

US 2015/0198175 A1 Jul. 16, 2015

(30) Foreign Application Priority Data

Jan. 16, 2014 (TW) ..... 103200935 U

(51) Int. Cl.
*F04D 29/34* (2006.01)
*F04D 29/00* (2006.01)
*F04D 25/08* (2006.01)

(52) U.S. Cl.
CPC ..... *F04D 29/34* (2013.01); *F04D 25/088* (2013.01); *F04D 29/005* (2013.01)

(58) Field of Classification Search
CPC ..... F04D 25/088; F04D 29/34; F04D 29/646
USPC ..... 416/212 R, 220 R
See application file for complete search history.

(56) References Cited

U.S. PATENT DOCUMENTS 5,944,487 A * 8/1999 Pearce ..... F04D 25/088 29/889.3
6,840,739 B2 * 1/2005 Cortez ..... F04D 29/34 416/210 R
8,770,937 B2 * 7/2014 Fizer ..... F04D 25/088 416/210 R
2009/0246028 A1 * 10/2009 Richardson ..... F04D 29/34 416/210 R
2012/0087796 A1 * 4/2012 McMahon ..... F04D 29/34 416/210 R
2013/0189109 A1 * 7/2013 Noble ..... F01D 5/02 416/219 R
2014/0119925 A1 * 5/2014 Wang ..... F04D 29/34 416/204 R

* cited by examiner

*Primary Examiner* — Kevin Murphy
(74) *Attorney, Agent, or Firm* — Trop Pruner & Hu, P.C.

(57) ABSTRACT

A ceiling fan includes a motor, a bracket unit connected fixedly on the motor and including a plurality of angularly spaced-apart blade-installation members, a plurality of blades and a mounting unit. Each blade has a locking segment registered with a respective one of the blade-installation members and a covering wing registered with a respective one of the blade-installation members. The locking segment and the covering wing of each of the blades are registered with two adjacent ones of the blade-installation members. The mounting unit includes a plurality of fastener sets, each securing the locking segment of a respective blade to a corresponding blade-installation member, and having a bottom end that is covered by a corresponding covering wing.

10 Claims, 7 Drawing Sheets

CEILING FAN

CROSS-REFERENCE TO RELATED APPLICATION

This application claims priority of Taiwanese Patent Application No. 103200935, filed on Jan. 16, 2014, the entire disclosure of which is hereby incorporated by reference.

BACKGROUND OF THE INVENTION

1. Field of the Invention

This invention relates to a fan, more particularly to a ceiling fan.

2. Description of the Related Art

Referring to FIG. 1, U.S. Pat. No. 5,944,487 discloses a conventional ceiling fan. The conventional ceiling fan includes a motor 5, an annular bracket 6, a plurality of blades 7 and a plurality of bolt fasteners 8. The motor 5 includes a rotor 51 having a central axis. The bracket 6 is connected fixedly on the rotor 51 and includes a plurality of angularly spaced-apart blade-installation members 61 surrounding the central axis. Each of the blades 7 has a root portion disposed under a respective one of the blade-installation members 61, and a blade portion projecting from the root portion. Each of the bolt fasteners 8 extends parallel to the central axis through the root portion of one of the blades 7 and the respective one of the blade installation members 61, and has a head 81 exposed from a bottom surface of the blade 7, thereby adversely affecting aesthetic appeal of the conventional ceiling fan.

Referring to FIG. 2, U.S. Pat. No. 6,840,739 discloses another conventional ceiling fan. This conventional ceiling fan includes a plurality of brackets 6' (only one is shown), a plurality of blades 7' (only one is shown), a plurality of bolt fasteners 8 and a plurality of decorative members 9' (only one is shown). Each of the brackets 6' is connected fixedly on a rotor (not shown) and includes a blade-installation member 61'. Each of the blades 7' has a root portion disposed under the blade-installation member 61' of a respective one of the brackets 6'. Each of the bolt fasteners 8' extends upwardly through the root portion of one of the blades 7' and the blade-installation member 61' of the respective one of the brackets 6'. Each of the decorative members 9' is connected fixedly to a respective one of the blades 7' so as to cover the bolt fasteners 8 thereon, thereby enhancing aesthetic appeal of the conventional ceiling fan. However, this conventional ceiling fan is relatively difficult and inconvenient to assemble due to its relatively complex configuration.

SUMMARY OF THE INVENTION

Therefore, the object of the present invention is to provide a ceiling fan that can overcome the aforesaid drawbacks of the prior art.

According to this invention, a ceiling fan includes a motor, a bracket unit, a plurality of blades and a mounting unit. The motor includes a rotor having a central axis. The bracket unit is connected fixedly on the rotor and includes a plurality of angularly spaced-apart blade-installation members surrounding the central axis. Each of the blades has an inner portion having a locking segment that is registered with a respective one of the blade-installation members and a covering wing that is registered with a respective one of the blade-installation members. The locking segment and the covering wing of each of the blades are registered with two adjacent ones of the blade-installation members. The covering wing of the inner portion of each of the blades extends under the locking segment of the inner portion of a corresponding adjacent one of the blades. The mounting unit includes a plurality of fastener sets. Each of the fastener sets secures the locking segment of a respective one of the blades to the respective registered one of the blade-installation members of the bracket unit, and has a bottom end covered by the covering wing of the corresponding adjacent one of the blades.

BRIEF DESCRIPTION OF THE DRAWINGS

Other features and advantages of the present invention will become apparent in the following detailed description of the preferred embodiment of this invention, with reference to the accompanying drawings, in which.

DETAILED DESCRIPTION OF THE PREFERRED EMBODIMENT

Figure 3:
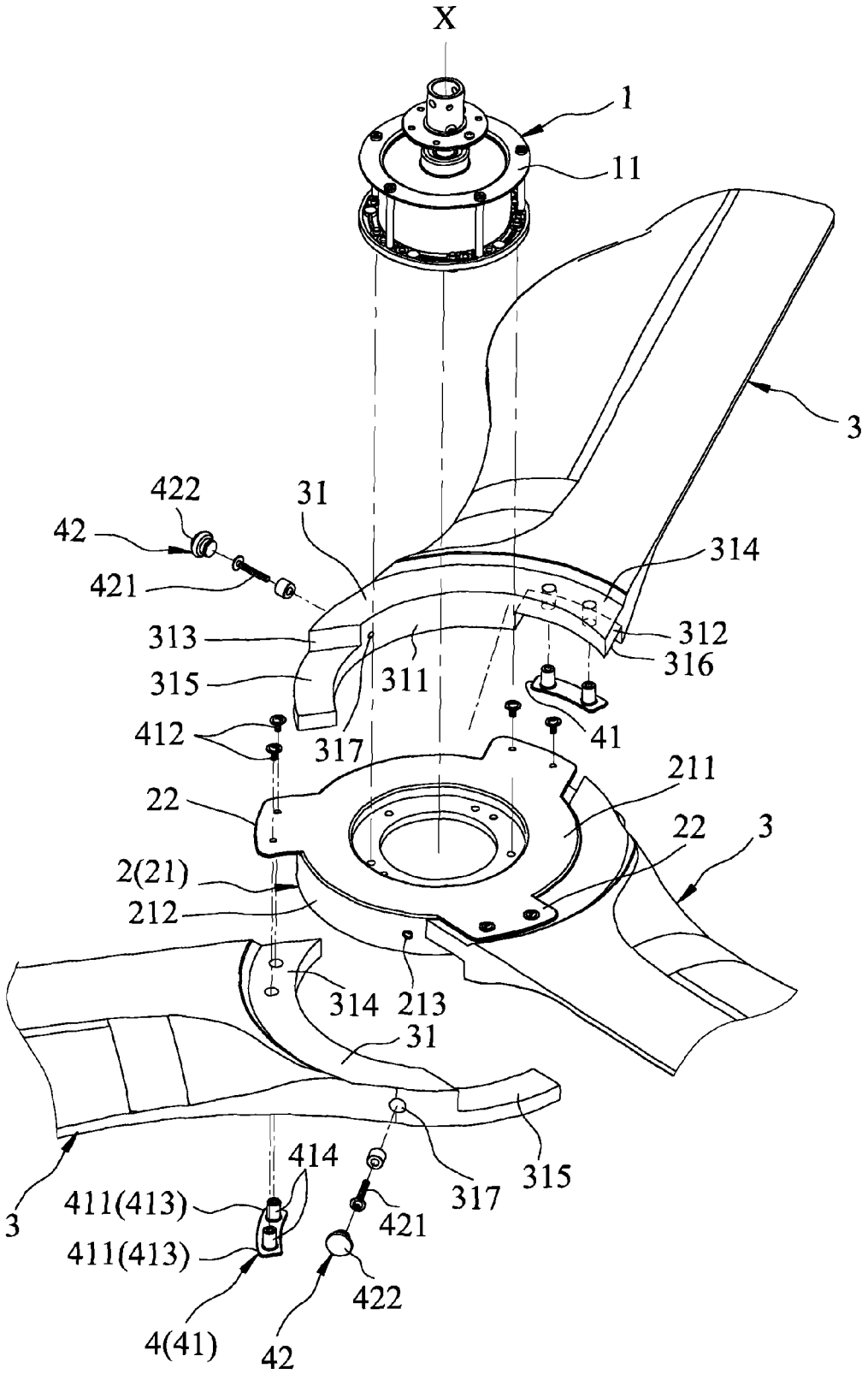
FIG. 3 is a fragmentary partly exploded perspective view of the preferred embodiment of a ceiling fan according to this invention.
Figure 4:
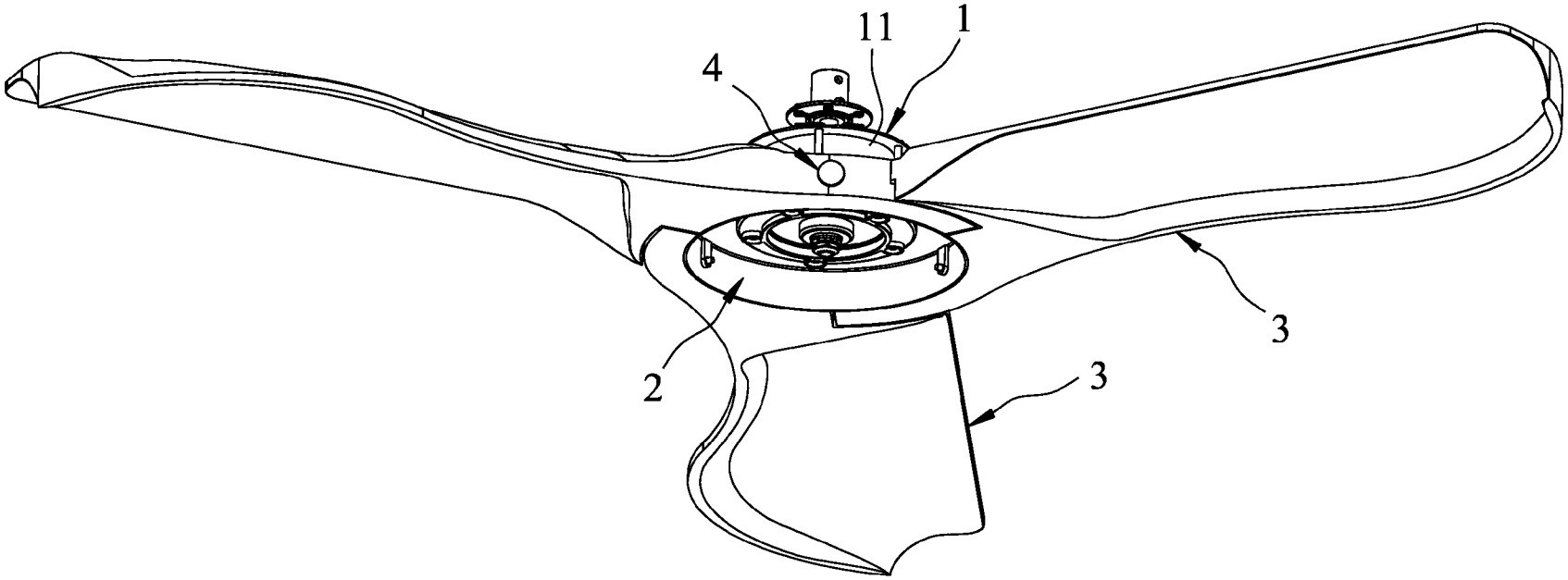
FIG. 4 is an assembled perspective view of the preferred embodiment.

Referring to FIGS. 3 and 4, the preferred embodiment of a ceiling fan according to the present invention includes a motor 1, a bracket unit 2, a plurality of blades 3 and a mounting unit 4.

The motor 1 includes a rotor 11 having a central axis (X). The bracket unit 2 is connected fixedly on the rotor 11 and includes a main body 21 and a plurality of angularly spaced-apart blade-installation members 22. The main body 21 has an annular base wall 211 connected fixedly to the rotor 11 and surrounding the central axis (X), and an annular surrounding wall 212 extending downwardly from a periphery of the base wall 211, and formed with a plurality of radially-extending threaded holes 213 (only one is visible in FIG. 3). The blade-installation members 22 extend radially and outwardly from the base wall 211. In this embodiment, the blade-installation members 22 and the main body 21 of the bracket unit 2 are formed integrally as one piece.

Figure 5:
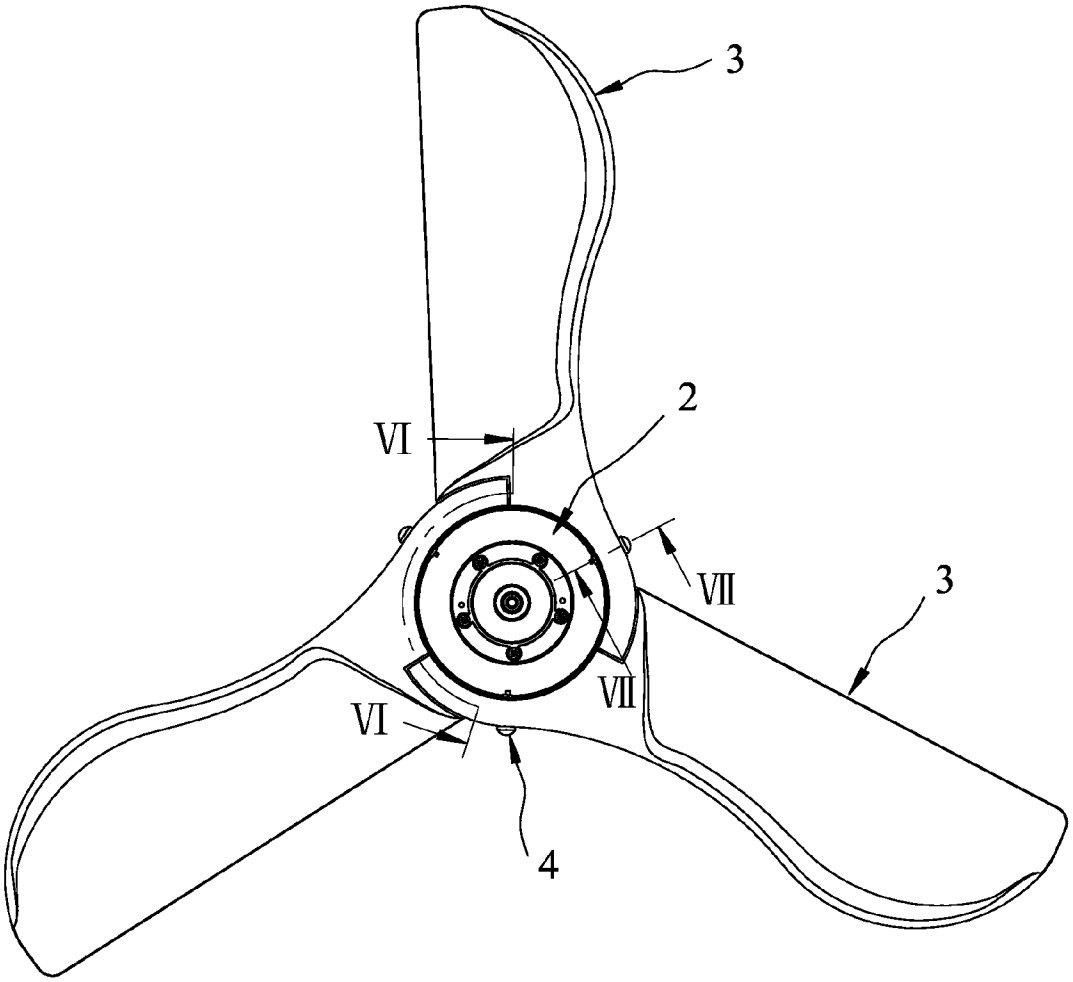
FIG. 5 is a bottom view of the preferred embodiment.
Figure 6:
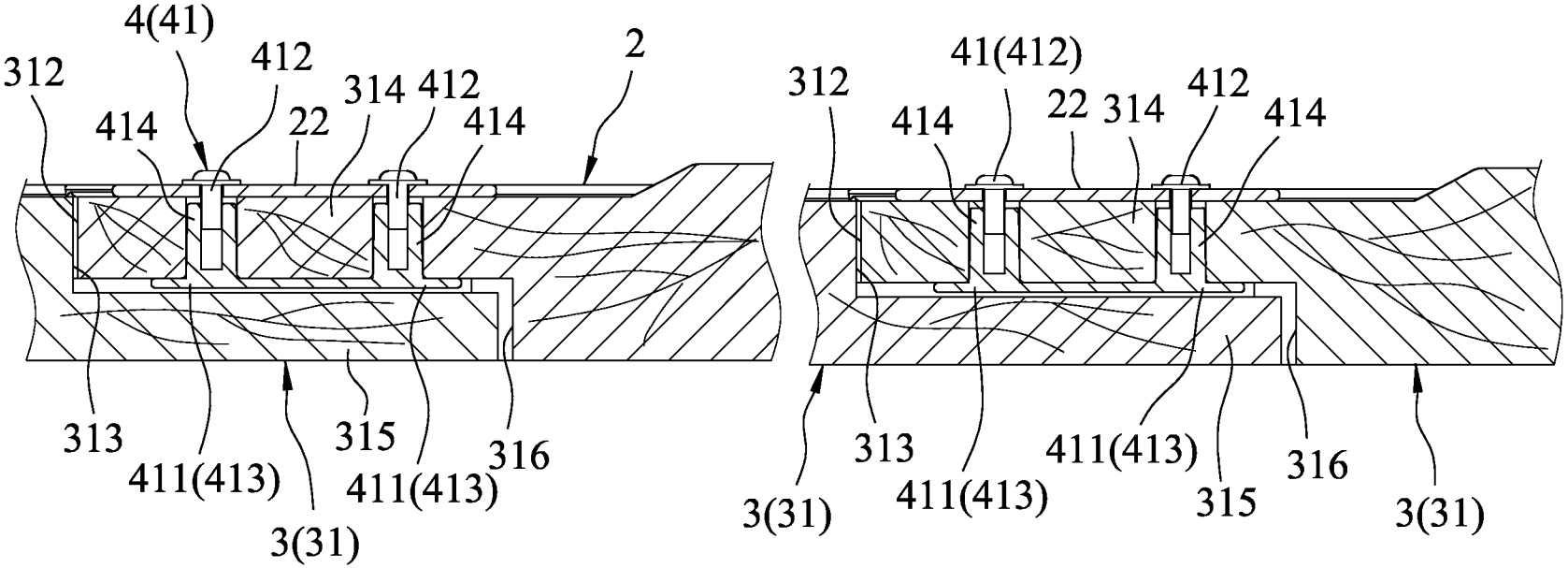
FIG. 6 is a fragmentary sectional view of the preferred embodiment taken along line VI-VI in FIG. 5.

Referring to FIGS. 3, 5 and 6, each of the blades 3 has an inner portion 31 disposed at a lower position relative to the blade-installation members 22 and having a locking segment 314 and a covering wing 315. The locking segment 314 is registered with a respective one of the blade-installation members 22, the covering wing 315 is registered with a respective one of the blade-installation members 22, and the locking segment 314 and the covering wing 315 are registered with two adjacent ones of the blade-installation members 22. The locking segment 314 is disposed under the respective one of the blade-installation members 22. That is to say, from the perspective of each blade-installation member 22, there is a respective registered set of locking segment 314 and covering wing 315 that originate respectively from two corresponding adjacent blades 3.

The inner portion 31 of each of the blades 3 further has an inner arc surface 311 formed on the locking segment 314, abutting against the surrounding wall 212 and having two circumferentially-opposite distal ends, and first and second lateral surfaces 312, 313 extending respectively from the distal ends of the inner arc surface 311. The first lateral surface 312 of each of the blades 3 abuts against the second lateral surface 313 of a corresponding adjacent one of the blades 3. The second lateral surface 313 of each of the blades 3 abuts against the first lateral surface 312 of a corresponding adjacent one of the blades 3. More specifically, the first and second lateral surfaces 312, 313 of each blade 3 abut respectively against the second and first lateral surfaces 313, 312 of two oppositely adjacent ones of the blades 3.

The covering wing 315 of the inner portion 31 of each of the blades 3 extends from the second lateral surface 313 in a circumferential direction, and extends under the locking segment 314 of the inner portion 31 of a corresponding adjacent one of the blades 3.

The inner portion 31 of each of the blades 3 further has an indentation 316 and a radial through hole 317. The indentation 316 is formed in a bottom surface of the locking segment 314 and extends through the first lateral surface 312 to receive the covering wing 315 of the corresponding adjacent one of the blades 3. The covering wing 315 of each of the blades 3 has a bottom surface. The bottom surfaces of the covering wings 315 of the blades 3 are flush with each other, thereby reducing wind resistance and improving aesthetic appeal of the ceiling fan. The radial through hole 317 is registered with a respective one of the threaded holes 213.

The mounting unit 4 includes a plurality of fastener sets 41 and a plurality of securing member sets 42.

In this embodiment, each of the fastener sets 41 secures a respective registered set of the locking segment 314 and the blade-installation member 22, and has a bottom end covered by the covering wing 315 that is registered with the respective registered set of the locking segment 314 and the blade-installation member 22. Each of the fastener sets 41 includes at least one nut 411 and at least one bolt 412. Herein, each fastener set 41 includes two nuts 411 and two bolts 412. Each nut 411 has a head section 413 disposed in the indentation 316 that is formed in the locking segment 314 of the respective registered set, and a body section 414 extending upwardly from the head section 413 and through the locking segment 314 of the respective registered set. The bolt 412 extends through the blade-installation member 22 of the respective registered set and is secured fixedly and threadedly to a respective one of the nuts 411. In this embodiment, the head sections 413 of the nuts 411 of each of the fastener sets 41 are formed integrally as one piece.

Figure 7:
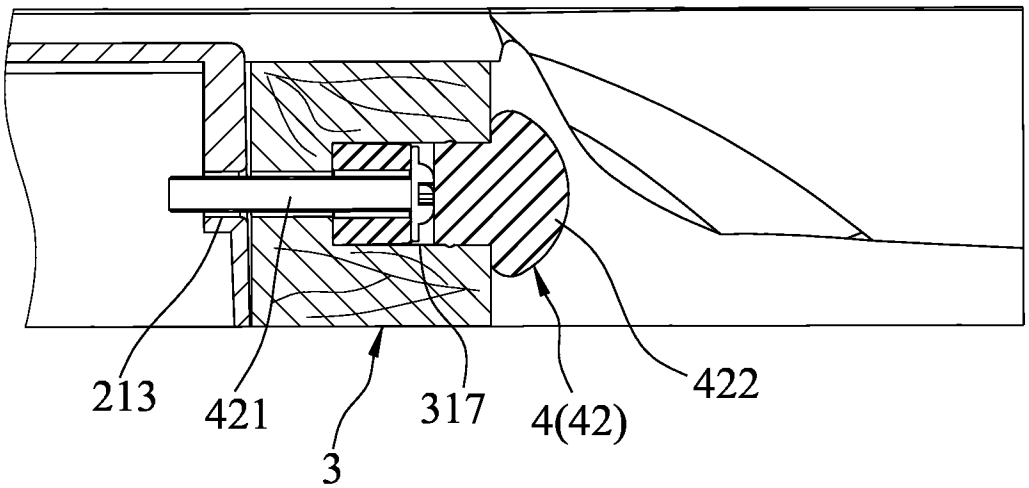
FIG. 7 is a fragmentary cross-sectional view of the preferred embodiment taken along line VII-VII in FIG. 5.

Referring to FIGS. 3, 5 and 7, each of the securing member sets 42 has a bolt 421 and a decorative plug 422. The bolt 421 extends through the radial through hole 317 of a respective one of the blades 3, and engages fixedly the respective one of the threaded holes 213 of the bracket unit 2. The decorative plug 422 covers the radial through hole 317 of the respective one of the blades 3 and the bolt 421.

Referring to FIGS. 3 and 6, an assembling process of the ceiling fan of this invention will be depicted in detail in the following description. To couple one of the blades 3 to the bracket unit 2, one of the fastener sets 41 is used with the nuts 411 being extended upwardly through the locking segment 314 of the blade 3 and the head sections 413 of the nuts 411 abutting against the bottom surface of the locking segment 314. Then, the blade 3 (with the nut 411 mounted thereon) is moved toward the bracket unit 2 until the locking segment 314 is registered with and disposed under the respective one of the blade-installation members 22 of the bracket unit 2. The bolts 412 of the one fastener set 41 are then inserted through the respective one of the blade-installation members 22 and the locking segment 314 so as to secure threadedly, respectively and fixedly the nuts 411. Afterward, the bolt 421 of one of the securing member sets 42 is inserted through the radial through hole 317 of the blade 3 to be secured threadedly and fixedly to the threaded hole 213 of the bracket unit 2. Finally, the decorative plug 422 of the one of the securing member sets 42 is placed to cover the radial through hole 317 and the bolt 421, thereby completing the installation process of the blade 3.

The rest of the blades 3 are installed one by one in the abovementioned manner. It is worth noting that the last one of the blades 3 has to be moved in a radial direction to have the locking segment 314 be sandwiched between the corresponding one of the blade-installation members 22 and the covering wing 315 of the corresponding adjacent one of the blades 3.

Figure 1:
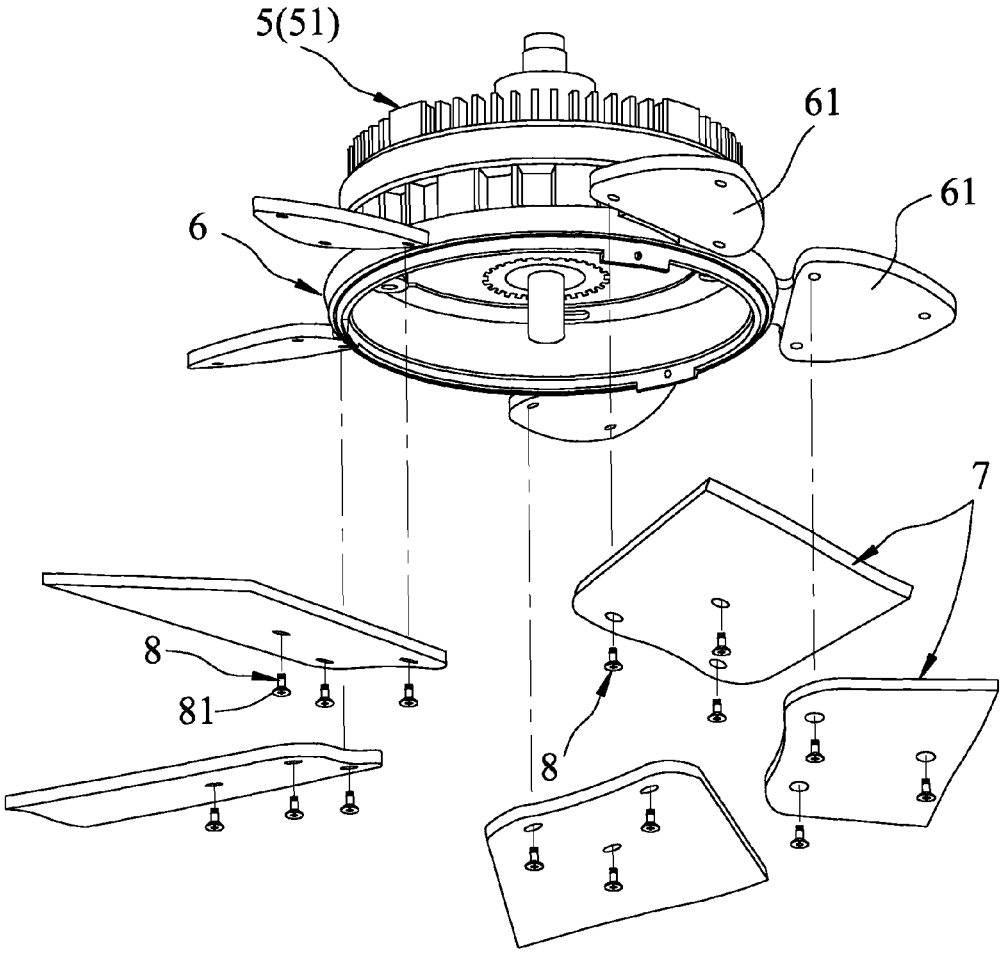
FIG.1 PRIOR ART
FIG. 1 is a fragmentary partly exploded perspective view showing a conventional ceiling fan illustrated in U.S. Pat. No. 5,944,487.
Figure 2:
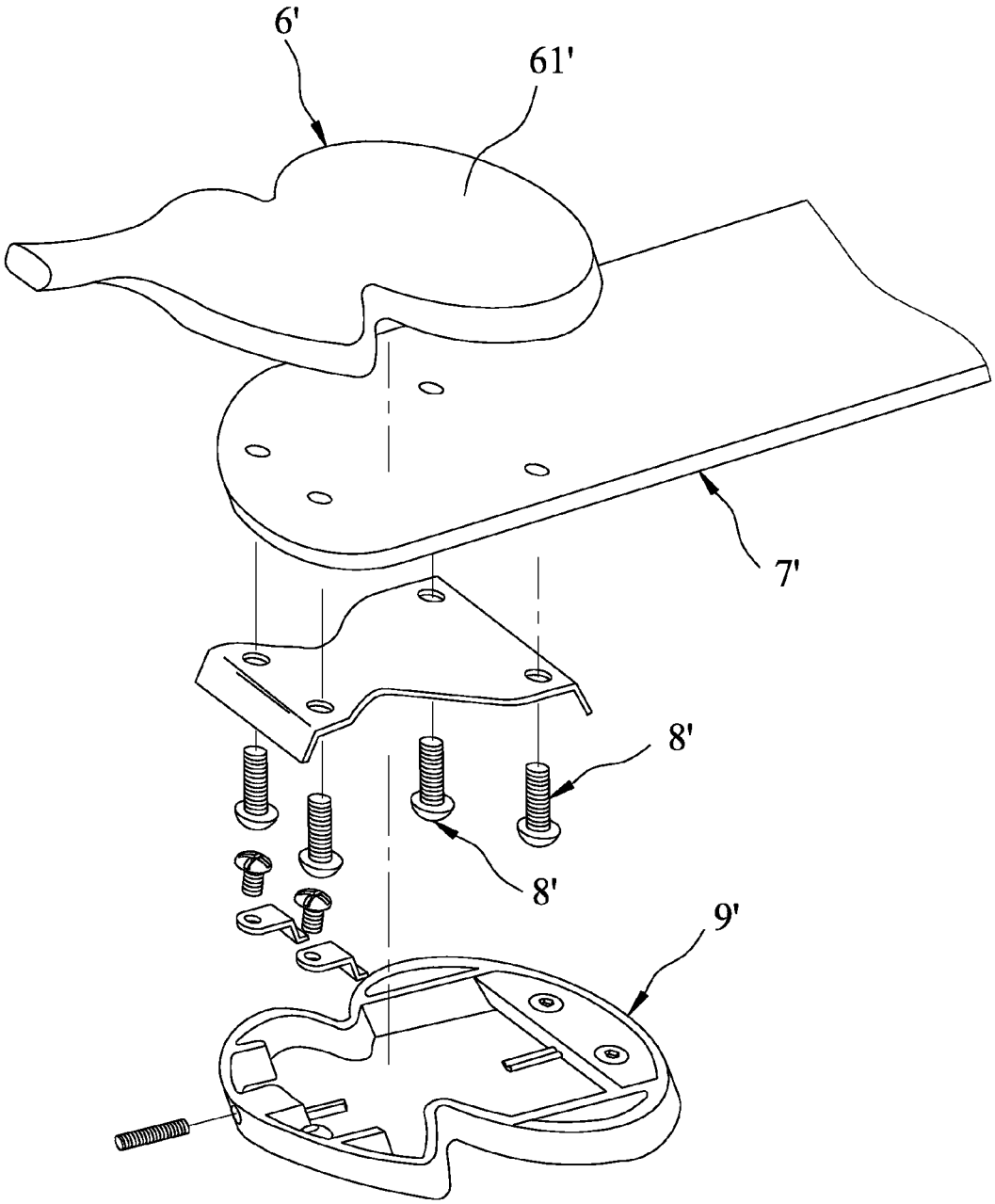
FIG.2 PRIOR ART
FIG. 2 is a fragmentary exploded perspective view showing another conventional ceiling fan illustrated in U.S. Pat. No. 6,840,739.

To sum up, with the covering wings 315 of the blades 3 covering the fastener sets 41 of the mounting unit 4, the aesthetic appeal of the ceiling fan is improved. Moreover, the ceiling fan of this invention has fewer elements than the conventional ceiling fan illustrated in FIG. 2 which has the decorative members 9', thus having a simpler assembling process. As a result, the objects of the present invention can be accomplished.

While the present invention has been described in connection with what are considered the most practical and preferred embodiment, it is understood that this invention is not limited to the disclosed embodiment but is intended to cover various arrangements included within the spirit and scope of the broadest interpretation and equivalent arrangements.

What is claimed is:

1. A ceiling fan comprising:

a motor including a rotor that has a central axis;

a bracket unit connected fixedly on said rotor and including a plurality of angularly spaced-apart blade-installation members that surround the central axis;

a plurality of blades, each of said blades having an inner portion that has a locking segment registered with a respective one of said blade-installation members and a covering wing registered with a respective one of said blade-installation members, said locking segment and said covering wing of each of said blades being registered with two adjacent ones of said blade-installation members, said covering wing of said inner portion of each of said blades extending under said locking segment of said inner portion of a corresponding adjacent one of said blades; and a mounting unit including a plurality of fastener sets, each of said fastener sets securing said locking segment of a respective one of said blades to the respective registered one of said blade-installation members of said bracket unit, and having a bottom end that is covered by said covering wing of the corresponding adjacent one of said blades.

2. The ceiling fan as claimed in claim 1, wherein said bracket unit further includes a main body having a base wall that is connected fixedly to said rotor and a surrounding wall that extends downwardly from a periphery of said base wall, said blade-installation members extending outwardly from said base wall.

3. The ceiling fan as claimed in claim 2, wherein said blade-installation members and said main body of said bracket unit are formed integrally as one piece.

4. The ceiling fan as claimed in claim 2, wherein said surrounding wall is annular.

5. The ceiling fan as claimed in claim 4, wherein said inner portion of each of said blades further has an inner arc surface abutting against said surrounding wall.

6. The ceiling fan as claimed in claim 5, wherein:

said inner arc surface has two circumferentially-opposite distal ends;

said inner portion of each of said blades further has a first lateral surface and a second lateral surface extending respectively from said distal ends of said inner arc surface, said first lateral surface of each of said blades abutting against said second lateral surface of a corresponding adjacent one of said blades, said second lateral surface of each of said blades abutting against said first lateral surface of a corresponding adjacent one of said blades.

7. The ceiling fan as claimed in claim 6, wherein:

said first lateral surface of each of said blades is formed on said locking segment; and said covering wing of each of said blades extends from said second lateral surface under said locking segment of the corresponding adjacent one of said blades.

8. The ceiling fan as claimed in claim 7, wherein:

said inner portion of each of said blades further has an indentation that is formed in a bottom surface of said locking segment and that extends through said first lateral surface to receive said covering wing of the corresponding adjacent one of said blades; and said covering wing of each of said blades has a bottom surface, said bottom surfaces of said covering wings of said blades being flush with each other.

9. The ceiling fan as claimed in claim 8, wherein:

said locking segment of each of said blades is disposed under the respective one of said blade-installation members of said bracket unit; and each of said fastener sets includes a nut having a head section that is disposed in said indentation of said inner portion of the respective one of said blades and a body section that extends upwardly from said head section and through said locking segment of the respective one of said blades, and a bolt extending through the respective one of said blade-installation members of said bracket unit and securing fixedly said nut.

10. The ceiling fan as claimed in claim 5, wherein:

said surrounding wall of said bracket unit is formed with a plurality of threaded holes;

said inner portion of each of said blades further has a radial through hole registered with a respective one of said threaded holes; and said mounting unit further includes a plurality of securing member sets, each of said securing member sets having a bolt that extends through said radial through hole of said inner portion of a respective one of said blades and that engages fixedly the respective one of said threaded holes of said surrounding wall of said bracket unit, and a decorative plug that covers said radial through hole of said inner portion of the respective one of said blades and said bolt.

* * * * *